US005704880A

United States Patent [19]

Amatulle

[11] Patent Number: 5,704,880

[45] Date of Patent: Jan. 6, 1998

[54] DEVICE FOR AN ARM FREE INCLINED TREADMILL WORKOUT

[76] Inventor: Pasquale J. Amatulle, 30 Mountainview Ave., Pearl River, N.Y. 10965

[21] Appl. No.: 726,676

[22] Filed: Oct. 7, 1996

[51] Int. Cl.[6] ..... A63B 21/02

[52] U.S. Cl. ..... 482/54; 482/74; 482/124

[58] Field of Search ..... 482/74, 114, 124, 482/131, 54

[56] References Cited

U.S. PATENT DOCUMENTS 4,441,707 4/1984 Bosch ..... 482/74
5,141,223 8/1992 Block ..... 482/124
5,176,597 1/1993 Bryne ..... 482/74
5,372,565 12/1994 Burdenko ..... 482/124
5,411,461 5/1995 Thomascik ..... 482/74

*Primary Examiner*—Lynne A. Reichard
*Attorney, Agent, or Firm*—Furgang & Milde, LLP

[57] ABSTRACT

The present invention provides for a device for an arm free treadmill workout. It has a belt having a left side and a right side. There is a left loop attached to the left side of the belt. The device has a right loop attached to the right side of the belt. A first strap has a first end connected to the left loop and a second end connected to the treadmill. A second strap has a first end connected to the right loop and a second end connected to the treadmill.

13 Claims, 2 Drawing Sheets

DEVICE FOR AN ARM FREE INCLINED TREADMILL WORKOUT

FIELD OF THE INVENTION

The present invention relates to a device for an arm free inclined treadmill workout.

BACKGROUND OF THE INVENTION

Fitness experts and professionals have continually emphasized the importance of a full body workout to increase cardiovascular circulation. For example, cross-country ski machines enable the user to exercise his legs as well as arms and upper body movement to increase cardiovascular circulation.

Treadmills although giving a vigorous workout restrict both of the user's arms from movement since the user must hold onto the front handle bars to maintain balance. In most cases after a 15 to 20 minute workout the user's arms are stiff or ache from holding onto the front handle bars. In addition, poor circulation results since the user's arms are held in a steadfast position, especially when the treadmill is inclined. Thus, a need exists to free the user's arms while exercising on a treadmill for a more complete full body workout.

SUMMARY OF THE INVENTION

Accordingly, the present invention provides for a device for an arm free inclined treadmill workout. To attain this, the device has a belt having a left side and a right side. There is a left loop attached to the left side of the belt. The device has a right loop attached to the right side of the belt. A first strap has a first end connected to the left loop and a second end connected to the treadmill. A second strap has a first end connected to the right loop and a second end connected to the treadmill.

Accordingly, it is an object of the present invention to provide a device that allows an arm free treadmill workout.

Another object of the present invention is to provide a device that supports the stomach and lower back when exercising, particularly on a treadmill.

Still another object of the present invention is to provide a device that affords stability and allows a person's arms to move freely back and forth in a natural movement.

Yet another object of the present invention is to furnish a device having an adjustable buckle for different lengths in strides.

A further object of the present invention is to provide a device having straps that can easily be uncoupled from the belt so that the belt can be used prior to or after any treadmill workout as a lower back support in more strenuous workouts.

These and still further objects will become apparent hereinafter.

These and other features of the present invention are described in more detail in the following detailed description when taken with the drawings. The scope of the invention, however, is limited only by the claims appended hereto.

BRIEF DESCRIPTION OF THE DRAWINGS

Various embodiments of the present invention are described and illustrated herein with reference to the drawings in which like items are indicated by the same reference, in which.

DETAILED DESCRIPTION OF THE PREFERRED EMBODIMENTS

Figure 1:
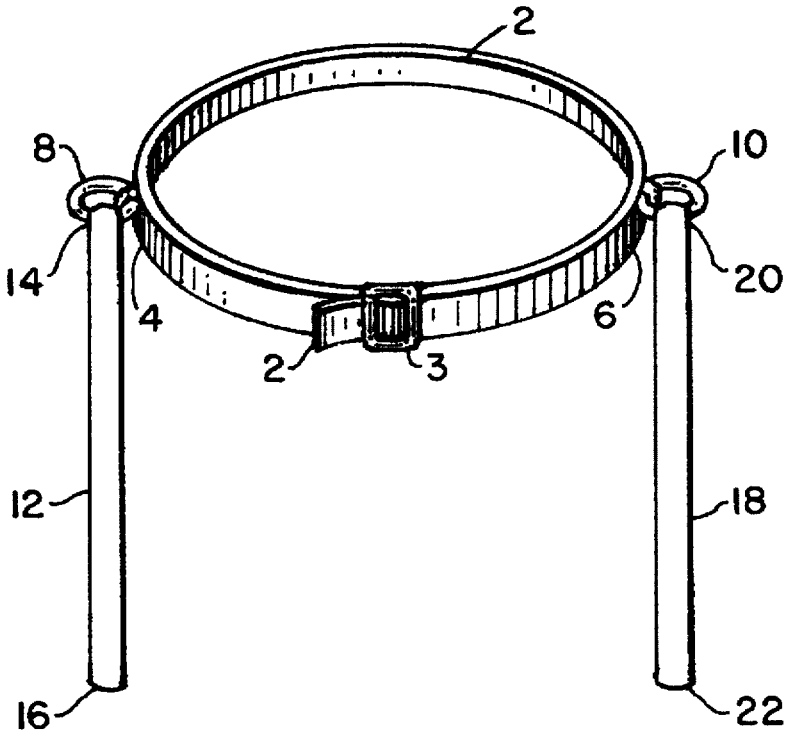
FIG. 1 is a perspective view of one embodiment of the device according to the present invention.

Turning now to the figures, FIG. 1 is a perspective view of one embodiment of the device embodying the present invention. The device has a belt 2 having a left side 4 and a right side 6. A left loop 8 is attached to the left side 4 of the belt 2. A right loop 10 is attached to the right side 6 of the belt 2. A first strap 12 has a first end 14 connected to the left loop 8 and a second end 16 connected (or connectable) to the treadmill. A second strap 18 has a first end 20 connected to the right loop 10 and a second end 22 connected (or connectable) to the treadmill.

Figure 2:
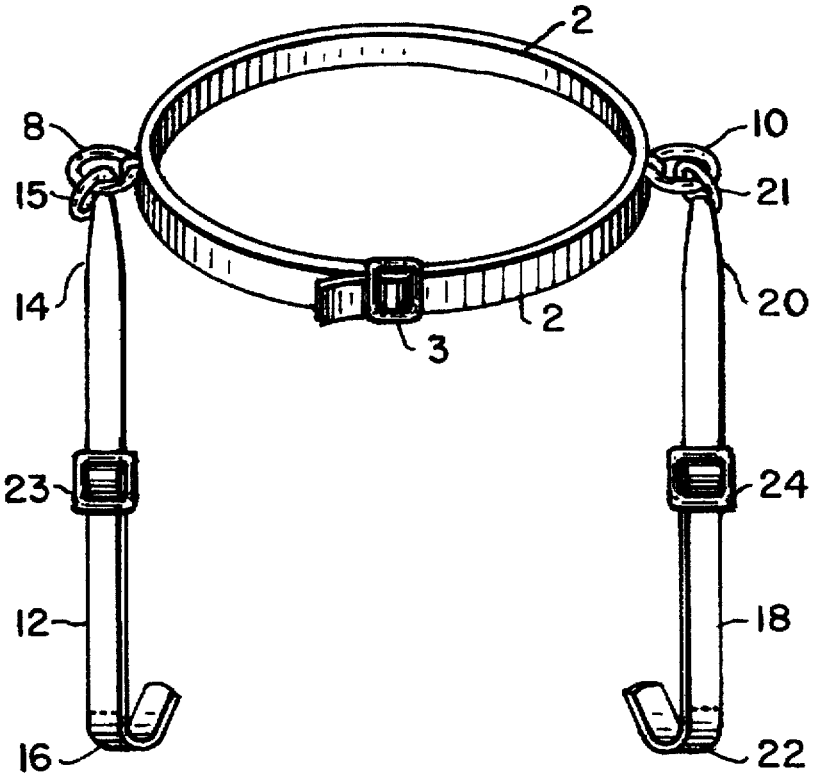
FIG. 2 is a view of one embodiment of the device according to the present invention wherein the first strap and second strap have adjustable buckles.

The second end 16 of the first strap 12 is preferably provided with VELCRO® hook and loop fastener on opposite sides to permit the strap to be looped and secured to the treadmill. The second end 22 of the second strap 18 is also preferably provided with VELCRO® hook and loop fastener to permit this second end to be secured to the treadmill in the same manner. The first strap 12 and the second strap 18 are preferably fabricated from a nonelastic material such as polypropylene. The belt 2 is preferably fabricated from a flexible material such as rubber, nylon or spandex. The belt 2 is wide enough to support the stomach and lower back of a person and can be adjustable by means of a buckle 3. In one embodiment of the invention, the first strap 12 and the second strap 18 have an adjustable buckle, 23 and 24 respectively, for adjusting to different strides. This is depicted in FIG. 2. The first strap 12 has a hook fastener 15 located on the first end 14 to secure this first strap to the left loop 8. The second strap 18 also has a hook fastener 21 located on the first end 20 to secure this second strap to the right loop 10.

Figure 3:
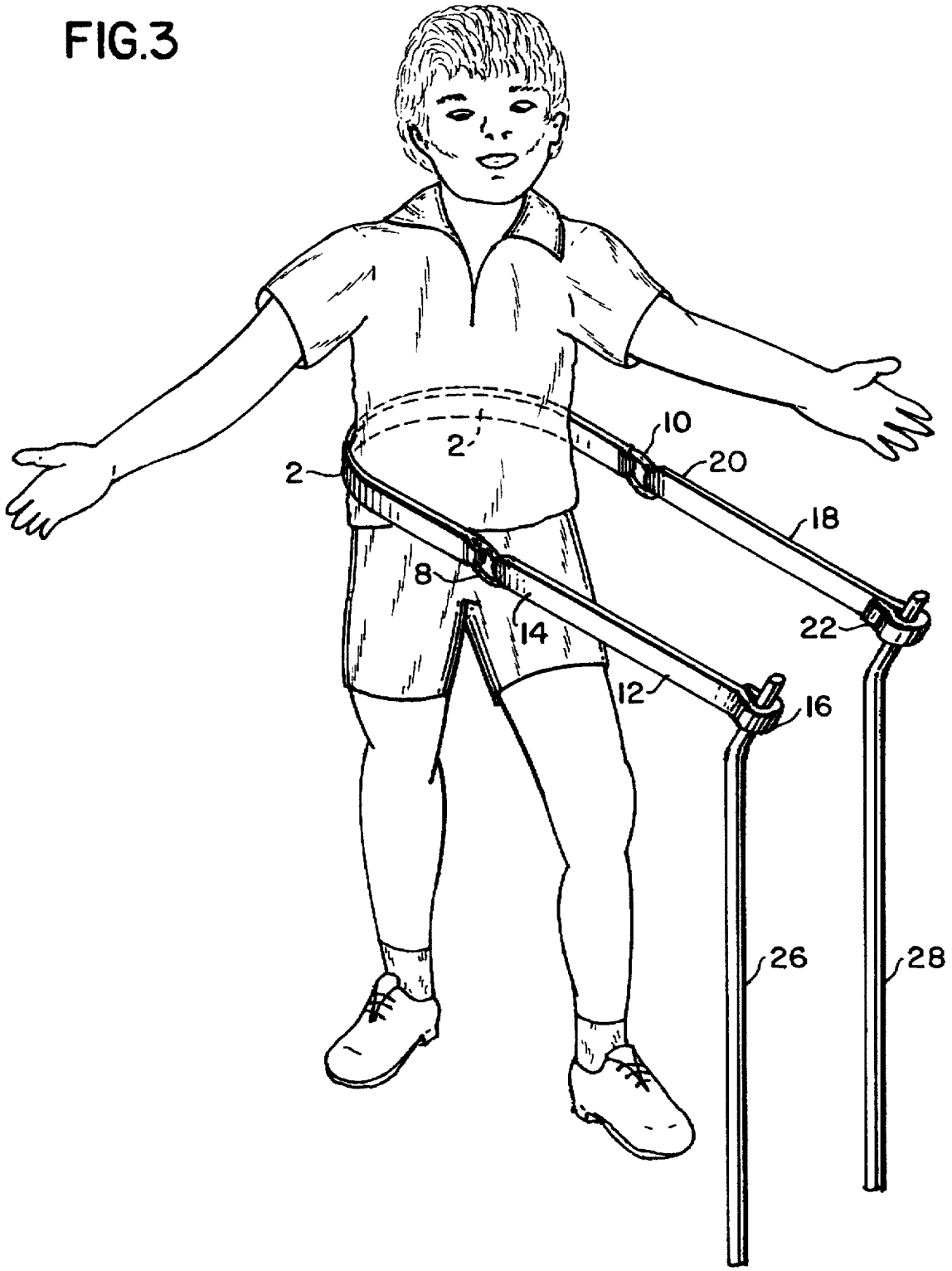
FIG. 3 is a view of one embodiment of the device of the present invention during use by a person.

FIG. 3 is a view of the device of the present invention during use by a person. As shown, the ends 16 and 22 of the straps 17 and 18, respectively, are connected to the upright handles 26 and 28 of a treadmill, thus freeing the arms of the user for normal movement while walking or running. The device is useful in therapeutics such as cardiac exercise for heart surgery patients as well as for hip, knee and back rehabilitation. The device allows the user to maintain balance, stability, strength and self-confidence.

From the above, it should be understood that the embodiments described, in regard to the drawings, are merely exemplary and that a person skilled in the art may make variations and modifications to the shown embodiments without departing from the spirit and scope of the invention. All such variations and modifications are intended to be included within the scope of the invention as defined by the appended claims.

What is claimed is:

1. In combination, a treadmill and a device for an arm-free treadmill workout comprising:

a belt having a left side and a right side;

a left loop attached to the left side of the belt;

a right loop attached to the right side of the belt;

a first strap having a first end connected to the left loop and a second end connected to the treadmill; and a second strap having a first end connection to the right loop and a second and connected to the treadmill, said device being capable of affording stability to the user without supporting a portion of the user's weight.

2. A device as in claim 1, wherein the second end of the first strap has hook and loop fastener to secure the second end of the first strap to the treadmill.

3. A device as in claim 1, wherein the second end of the second strap has hook and loop fastener to secure the second end of the second strap to the treadmill.

4. A device as in claim 1, wherein the belt is fabricated from the group consisting of flexible rubber, spandex, and nylon.

5. A device as in claim 1, wherein the belt supports the stomach and lower back of a person.

6. A device as shown in claim 1, wherein the belt is adjustable in circumference.

7. A device as in claim 1, wherein the first strap has an adjustable buckle for adjusting to different strides.

8. A device as in claim 1, wherein the second strap has an adjustable buckle for adjusting to different strides.

9. A device as in claim 1, wherein the first strap has a fastener located on the first end to secure the first strap to the left loop.

10. A device as in claim 9, wherein the fastener is a hook.

11. A device as in claim 1, wherein the first strap has a fastener located on the first end to secure the second strap to the right loop.

12. A device as in claim 11, wherein the fastener is a hook.

13. A method for using a treadmill for an arm-free treadmill workout, which comprises using the treadmill with a device attached to the treadmill comprising:

a belt having a left side and a right side;

a left loop attached to the left side of the belt;

a right loop attached to the right side of the belt;

a first strap having a first end connected to the left loop and a second end connected to the treadmill; and a second strap having a first end connected to the right loop and a second end connected to the treadmill, said device being capable of affording stability to the user without supporting a portion of the user's weight.

* * * * *